US008297310B2

(12) United States Patent
Ishibashi et al.

(10) Patent No.: US 8,297,310 B2
(45) Date of Patent: Oct. 30, 2012

(54) AIR PUMP

(75) Inventors: Shigemitsu Ishibashi, Kawasaki (JP); Atsuki Hashimoto, Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 0 days.

(21) Appl. No.: 13/193,102

(22) Filed: Jul. 28, 2011

(65) Prior Publication Data

US 2011/0284109 A1 Nov. 24, 2011

Related U.S. Application Data

(63) Continuation of application No. PCT/JP2010/051234, filed on Jan. 29, 2010.

(30) Foreign Application Priority Data

Jan. 30, 2009 (JP) ..... 2009-019849

(51) Int. Cl.
*E03B 5/00* (2006.01)
*F04B 35/04* (2006.01)

(52) U.S. Cl. ..... 137/565.18; 137/574; 417/418; 220/581; 220/62.18

(58) Field of Classification Search ..... 127/565.18, 127/574; 417/418; 220/62.18, 501, 581, 220/625

See application file for complete search history.

(56) References Cited

U.S. PATENT DOCUMENTS 1,998,338 A * 4/1935 Spohrer ..... 137/565.18
3,661,294 A * 5/1972 Pearson et al. ..... 220/62.18
3,662,780 A * 5/1972 Marsh ..... 220/581
5,011,379 A * 4/1991 Hashimoto ..... 417/418
5,704,512 A * 1/1998 Falk et al. ..... 220/581
6,540,491 B1 * 4/2003 Tanabe ..... 417/417
6,810,901 B2 * 11/2004 Burford ..... 137/565.18
7,036,677 B1 * 5/2006 Funck et al. ..... 220/581
2009/0081058 A1 3/2009 Ishibashi et al.
2009/0194177 A1 * 8/2009 Yokota et al. ..... 137/565.18
2011/0274571 A1 * 11/2011 Ishibashi et al. ..... 417/417
2011/0280751 A1 * 11/2011 Ishibashi ..... 417/415

(Continued)

FOREIGN PATENT DOCUMENTS

GB 2436858 A 10/2007

(Continued)

OTHER PUBLICATIONS

International Search Report for International Application No. PCT/JP2010/051234, dated Apr. 20, 2010, 2 pages.

*Primary Examiner* — John Rivell

(74) *Attorney, Agent, or Firm* — Brinks Hofer Gilson & Lione

(57) ABSTRACT

An air pump has an air tank (20) for temporarily storing air from a pump unit (12) before discharging the air. The air tank has a tank body having a top wall (40) on which the pump unit is placed, and a peripheral wall (42) extending downward from the top wall. The tank body has a downward facing opening. The air tank further has a metallic bottom wall member (46) engaged with the bottom surface of the peripheral wall so as to close the opening of the tank body. Bolts are passed through the metallic bottom wall member and into a metallic part of the pump unit and tightened to connect and secure the pump unit and the air tank to each other.

10 Claims, 9 Drawing Sheets

U.S. PATENT DOCUMENTS

2011/0280752 A1* 11/2011 Ishibashi et al. ..... 417/415

FOREIGN PATENT DOCUMENTS

JP 04-041267 A 9/1992
JP 08-270556 A 10/1996
JP 10-169550 A 6/1998
JP 2000-130344 A 5/2000
JP 3485478 B2 1/2004
JP 2007-016761 A 1/2007

* cited by examiner

AIR PUMP

RELATED APPLICATIONS

This application is a continuation of PCT/JP2010/051234 filed on Jan. 29, 2010, which claims priority to Japanese Application No. 2009-019849 filed on Jan. 30, 2009. The entire contents of these applications are incorporated herein by reference.

BACKGROUND OF THE INVENTION

1. Field of the Invention

The present invention relates to electromagnetic air pumps and, more particularly, to an electromagnetic air pump having a resinous air tank for temporarily storing compressed air.

2. Description of the Related Art

An electromagnetic air pump has a pump unit having an electromagnetic drive section to suck in air from the surroundings and to compress the air and an air tank for temporarily storing the compressed air from the pump unit to remove pulsation caused in the compressed air by the pump unit before discharging the compressed air.

Air compressed by the air pump is heated to a considerably high temperature by adiabatic compression. Therefore, the air tank needs to be capable of effectively performing heat dissipation. For this purpose, for example, a space for heat dissipation is provided between the air tank and the pump unit (see Patent Literatures 1 and 2 noted below).

Patent Literature 1: Japanese Patent No. 3485478

Patent Literature 2: Japanese Examined Utility Model Application Publication No. Hei 4-41267 (1992-41267)

Some air pumps have a resinous air tank to reduce the weight thereof. Such air pumps suffer, however, from the following problems.

Resinous air tanks are more difficult to dissipate heat from than metallic air tanks. Accordingly, one conventional practice is to assemble the air tank and the pump unit away from each other so that a space for heat dissipation is formed therebetween. However, it is a complicated operation to assemble the air tank to the pump unit as stated above. In addition, the resinous air tank is likely to be thermally deformed when used for a long period of time, and such deformation of the air tank may impair air-tightness relative to the air pump.

An object of the present invention is to provide an electromagnetic air pump using a resinous air tank to achieve a weight reduction and yet free from the above-described problems.

SUMMARY OF THE INVENTION

The present invention provides an air pump including a pump unit and an air tank for temporarily storing air compressed in the pump unit before discharging the compressed air. The air tank has a resinous tank body having a top wall on which the pump unit is placed, and a peripheral wall extending downward from the top wall. The tank body has a downward facing opening. The air tank further has a metallic bottom wall member engaged with the bottom surface of the peripheral wall so as to close the opening of the tank body. Bolts are passed through the metallic bottom wall member and into a metallic part of the pump unit and tightened to securely connect the pump unit and the air tank to each other.

In this air pump, the resinous tank body is put between the metallic bottom wall member and a metallic part of the pump unit, and bolts are passed through from the bottom wall member and into the metallic part of the pump unit and tightened to securely connect the pump unit and the air tank to each other. Therefore, the resinous tank body can be firmly and easily secured to the pump unit with satisfactory sealing properties between the bottom wall member and the tank body. Accordingly, the tank body can be prevented from becoming deformed even if the air pump is used for a long period of time. In addition, disassembling and reassembling are easy when maintenance is performed on the air pump.

In addition, heat generated in the tank can be efficiently dissipated through the metallic bottom wall member, and the air pump can be made so that the heat of the air tank is not easily transmitted to the pump unit.

Specifically, the peripheral wall may have a double-wall structure comprising an outer wall, an inner wall, and at least one air gap between the outer and inner walls. The double-wall structure suppresses the transmission of vibration noise of air from the air tank to the outside.

Specifically, the at least one air gap may comprise a plurality of air gaps spaced from each other in the circumferential direction of the peripheral wall, and an intermediate wall may be provided between adjacent air gaps to connect together the outer and inner walls. This is for attaining a noise reduction effect of the peripheral wall and for maintaining the strength of the peripheral wall.

Further, the arrangement may be as follows. The tank body has a partition wall extending downward from the top wall thereof to partition the interior of the tank body into a plurality of spaces. The partition wall has an air passage formed therein to allow air introduced into the air tank to flow toward an air outlet of the air pump through the plurality of spaces. The partition wall is shorter in height than the peripheral wall. Between the partition wall and the bottom wall member is provided a seal member that is more pliable than the resin used to form the tank body. The reason why a partition wall with an air passage is provided is to reduce the pulsation of air discharged from the air tank. The reason why the partition wall is shorter than the peripheral wall and a relatively pliable seal member is provided is as follows. If the partition wall has the same height as that of the peripheral wall and is abutted directly against the bottom wall member to seal therebetween, sealing cannot be completed unless the lower surface of the peripheral wall and the lower surface of the partition wall are completely flush with each other. Consequently, the production process becomes difficult. For this reason, a relatively pliable seal member is interposed between the partition wall and the bottom wall member to allow the desired sealing to be attained even if the respective lower surfaces of the partition wall and the peripheral wall are not completely flush with each other. In addition, it is possible to obtain the effect of suppressing vibration transmitted from the pump unit to the bottom wall member by the arrangement in which the partition wall is not abutted directly against the bottom wall member, but a seal member more pliable than the partition wall is interposed between the partition wall and the bottom wall member.

For similar purposes, the inner wall may also be made shorter than the outer wall, and a seal member more pliable than the inner wall and the partition wall may be provided between the inner wall and the partition wall, on the one hand, and the bottom wall member, on the other.

In this case, the seal member may be a sheet-shaped member stacked on the inner surface of the bottom wall member so that the inner wall and the partition wall sealingly engage with the seal member. Provision of the seal member stacked on the inner surface of the bottom wall member makes it difficult for the pulsation of air entering the air tank to be transmitted to the bottom wall member.

Further, the above-described air pump may be arranged as follows. The pump unit includes a piston assembly of a pair of pistons and an armature connecting together the pair of pistons in the state that the pair of pistons are aligned with each other in the axial direction of the pistons, and a pair of electromagnets provided at the opposite sides, respectively, of the armature. When an alternating electric current is applied thereto, the electromagnets generate an alternating magnetic field to reciprocate the armature in the axial direction of the pistons. The pump unit further includes a pump casing having a pair of cylinder chambers slidably accommodating the pair of pistons, respectively, and a drive chamber accommodating the armature extending between the pair of cylinder chambers and the electromagnets. The pump casing has a peripheral wall defining the drive chamber. The peripheral wall of the pump casing has an electromagnet-loading opening extending through a bottom wall portion thereof to allow the electromagnets to be loaded into the drive chamber from the outside of the peripheral wall. The top wall of the air tank is sealingly engaged with the bottom wall portion of the pump casing to close the electromagnet-loading opening.

With the above-described arrangement, the electromagnet-loading opening can be closed by the air tank without separately providing a member for closing the electromagnet-loading opening.

In this case, the arrangement may further be as follows. The bottom wall portion of the pump casing has an air discharge opening for discharging air compressed in the pump unit to the outside of the pump casing. The air tank has an air inlet disposed to face the air discharge opening. A seal member is provided between the top wall of the air tank and the bottom wall portion of the pump casing. The seal member surrounds an air passage between the air discharge opening and the air inlet.

One embodiment of an air pump according to the present invention will be explained below in detail with reference to the accompanying drawings.

DETAILED DESCRIPTION OF THE PREFERRED EMBODIMENTS

Figure 1:
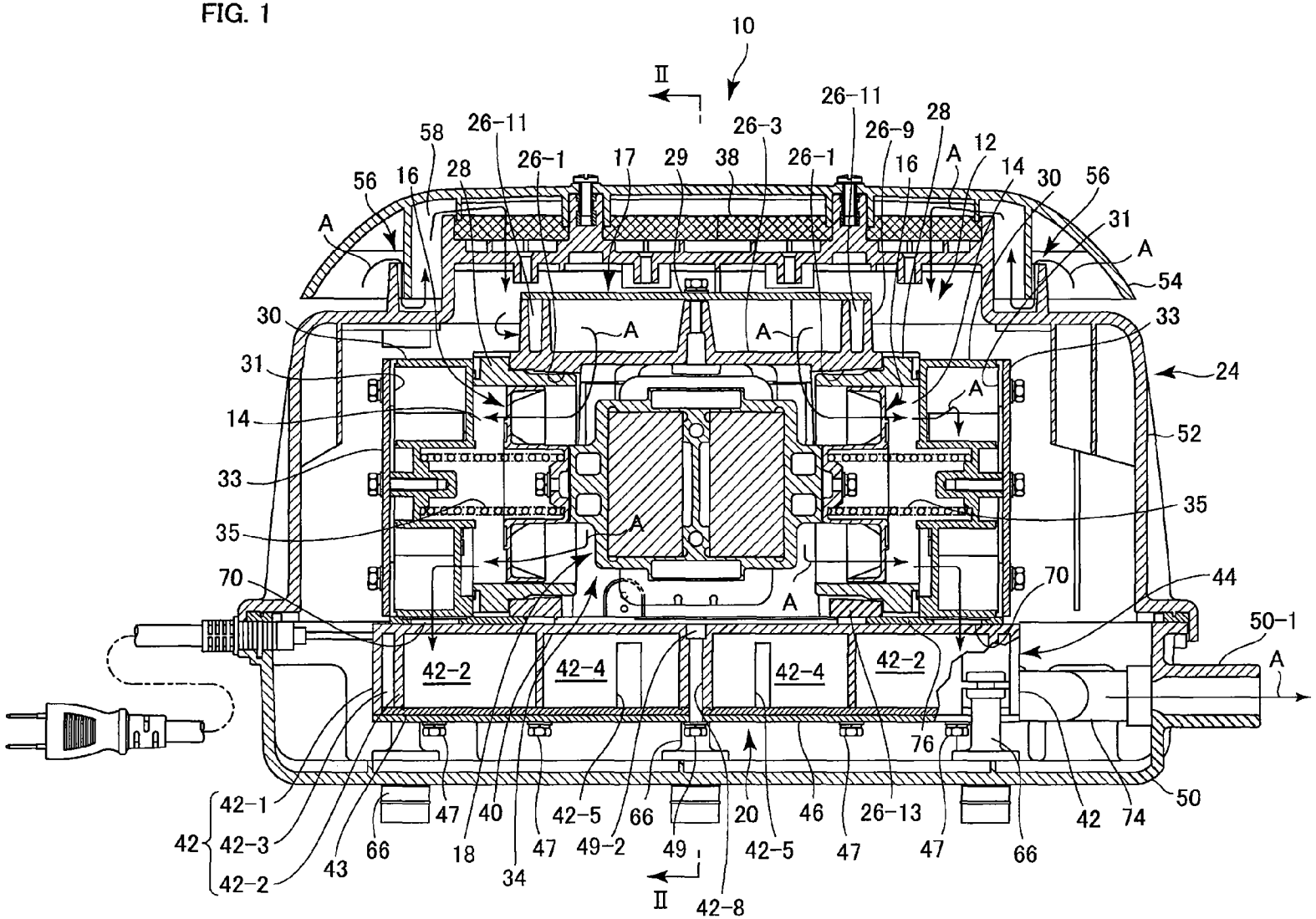
FIG. 1 is a vertical sectional view of an air pump according to the present invention.

As illustrated in the figures, an air pump 10 according to the present invention has a pump unit 12 for sucking in and compressing air from the surroundings and an air tank 20 for temporarily storing the compressed air from the pump unit 12 to suppress pulsation caused by reciprocating motion of pistons 16 of the pump unit 12 before discharging the compressed air. The air pump 10 further has a housing 24 accommodating the pump unit 12 and the air tank 20.

First, these constituent elements and the overall structure will be outlined below.

First, the pump unit 12 has a casing 17 having a pair of cylinder chambers 14 disposed in bilateral symmetry as seen in FIG. 1 to accommodate the pistons 16, respectively. The pump unit 12 further has an electromagnetic drive unit 18 reciprocating the two pistons 16 in the state of the two pistons being connected to each other. Specifically, the casing 17 has, as shown in FIGS. 2 to 5, a casing body 26 having a box shape as a whole and defining a drive chamber accommodating the electromagnetic drive unit 18, and a pair of cylinder members 28 fitted into through-holes 26-1 formed in left and right (as seen in FIG. 1) side walls 26-13, respectively, of the casing body 26. Further, the casing 17 has head covers 30 installed so as to sandwich the casing body 26 from the left and right sides of the latter, as seen in FIG. 1, to define the cylinder chambers 14 together with the cylinder members 28, and end wall members 33 abutted and secured to the respective end surfaces of the head covers 30 through seal members 31.

Figure 2:
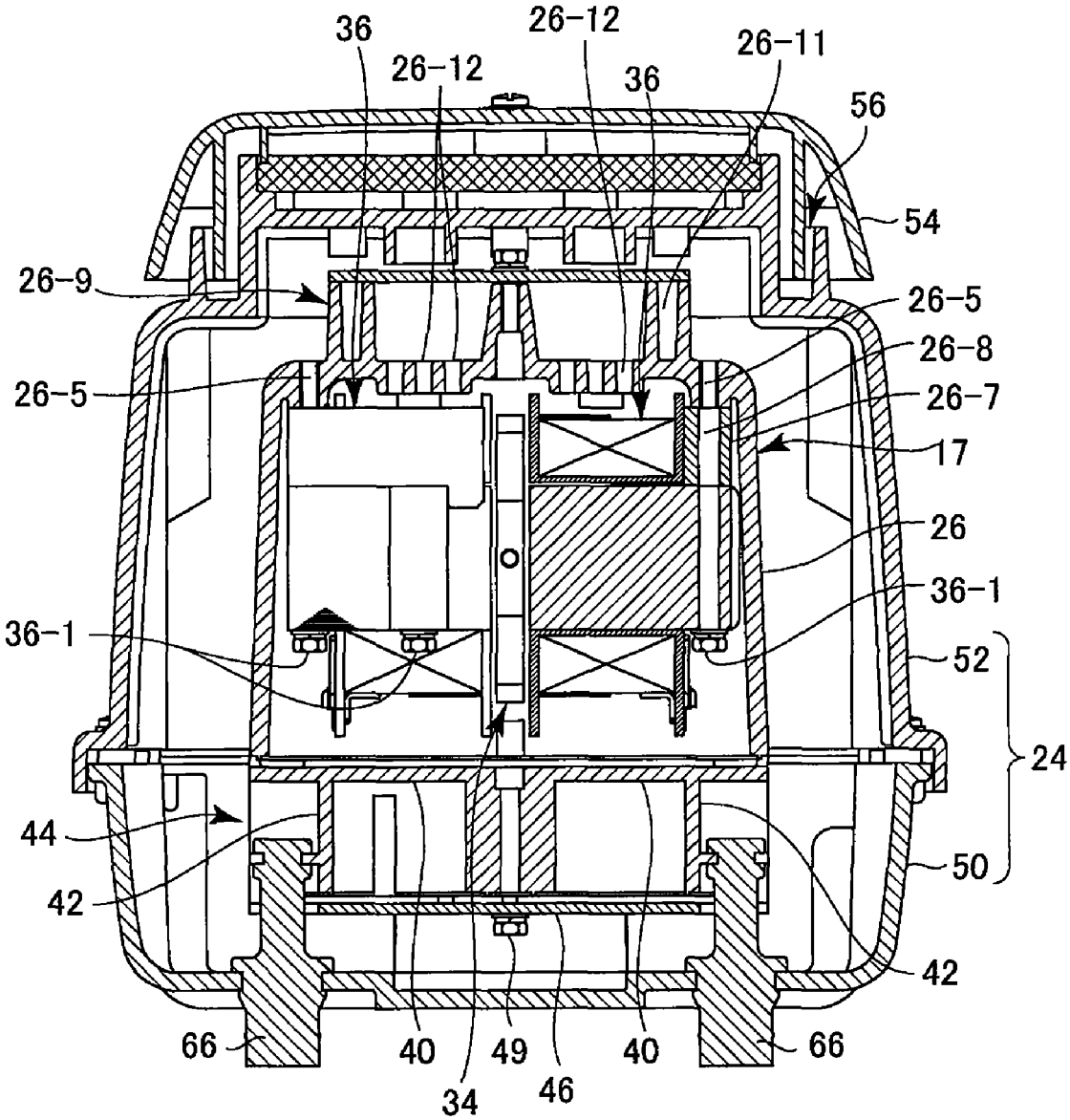
FIG. 2 is a sectional view taken along the line II-II in FIG. 1.
Figure 3:
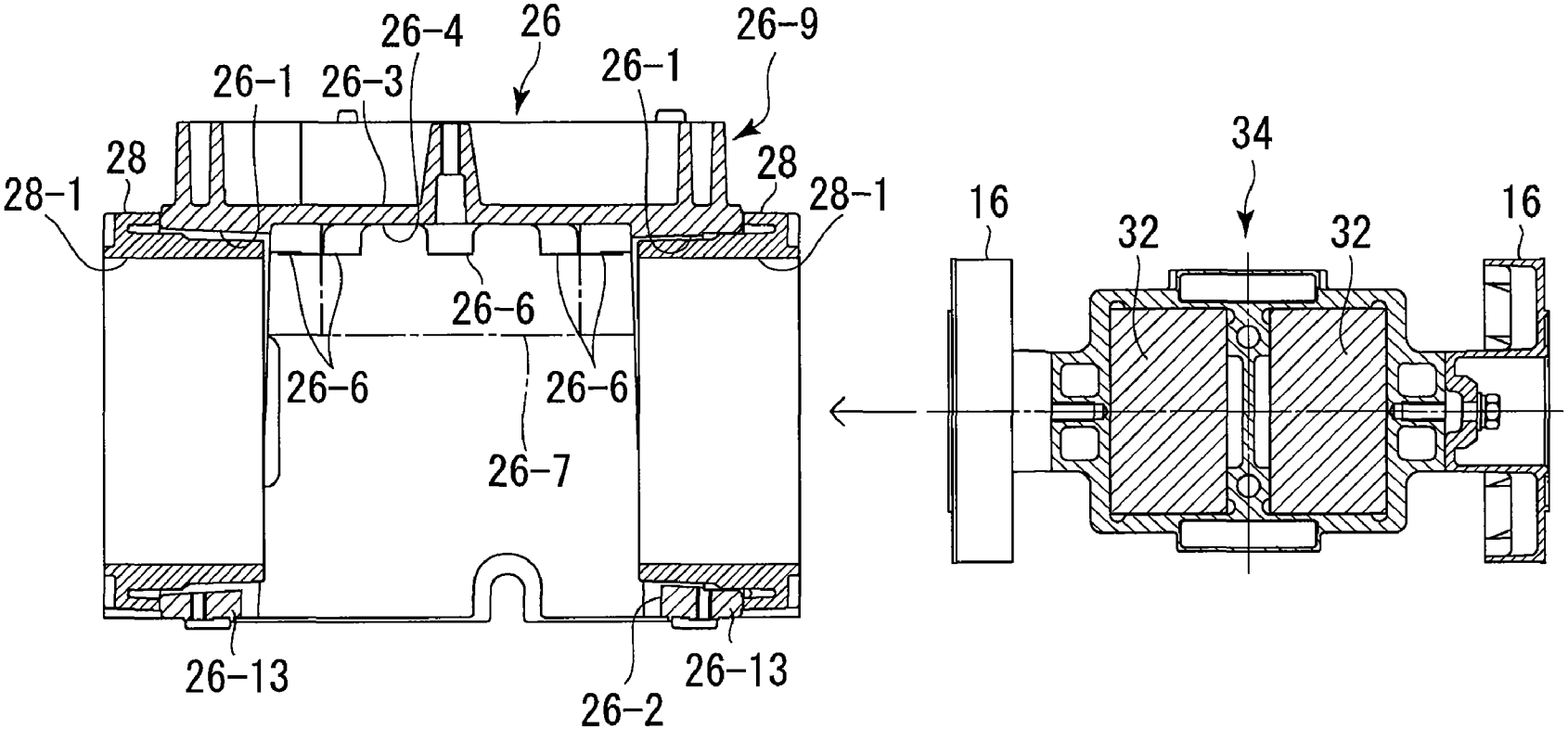
FIG. 3 is a sectional front view showing an assembly of a casing body constituting a casing of a pump unit and cylinder bodies and an assembly of pistons and an armature, in which only one of the pistons is not cut by the section line.
Figure 4:
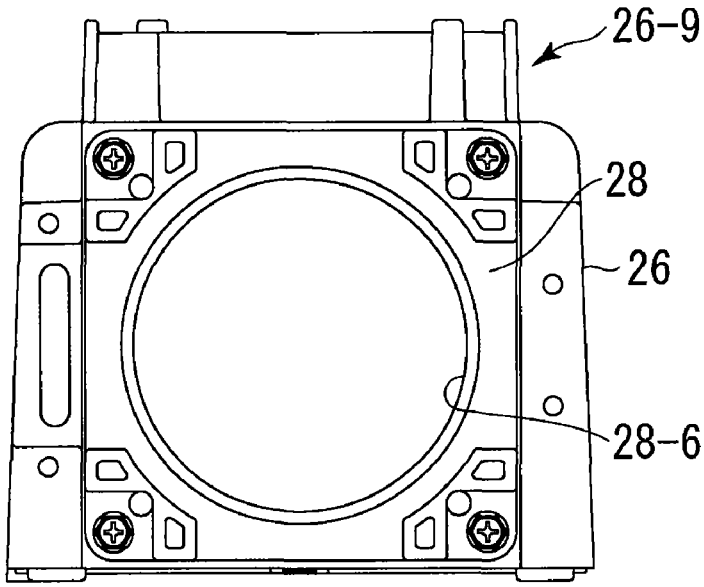
FIG. 4 is a side view of the assembly of the casing body and the cylinder bodies.

The electromagnetic drive unit 18 has an armature 34 connecting the pair of pistons 16 to each other and having plate-shaped permanent magnets 32 disposed in bilateral symmetry as seen in FIGS. 1 and 3, and electromagnets 36 provided at the opposite sides, respectively, of the armature 34 as seen in FIG. 2. The electromagnets 36 act on the permanent magnets 32, thereby causing the armature 34 to reciprocate in the lateral direction as seen in FIG. 1. Coil springs 35 are provided at the left and right sides, respectively, of the armature 34 as seen in FIG. 1 to hold the armature 34 in the center of the pump unit 12. When an alternating electric current is applied to the electromagnets 36, an alternating magnetic field is generated to reciprocate the armature 34 equipped with the permanent magnets 32, together with the pistons 16 at the opposite ends of the armature 34. Consequently, the surrounding air is sucked into the pump unit 12 through a filter 38 installed in the top of the housing 24. The sucked air is compressed in the cylinder chambers 14 and supplied into the air tank 20. The air flows as shown by the arrows A, although the details of the air flow path are not shown. The electromagnetic drive unit 18 is a technique known to those skilled in the art as disclosed, for example, in Japanese Patent Application Publication No. 2007-16761. Therefore, a detailed explanation of the structure of the electromagnetic drive unit 18 is omitted herein.

The air tank 20 has a resinous tank body 44 having a top wall 40 of a rectangular shape in plan view, on which the pump unit 12 is placed. The tank body 44 further has a peripheral wall 42 extending downward from the top wall 40. Thus, the tank body 44 has a downward facing opening. The air tank 20 further has a metallic bottom wall member 46 installed to close the opening of the tank body 44. The bottom wall member 46 has a plurality of bolts 47 passed through a peripheral edge portion thereof. The bolts 47 are thread-engaged with the metallic casing 17 of the pump unit and tightened to clamp the resinous tank body 44 between the metallic bottom wall member 46 and the casing 17.

Specifically, the housing 24, which accommodates the pump unit 12 and the air tank 20, has a flat-bottomed pan-shaped bottom part 50, a housing body 52 installed on the bottom part 50, and a cover 54 attached to the top of the housing body 52. An air intake passage 58 with a rainwater trap portion 56 is provided between the cover 54 and the housing body 52. Air introduced into the housing 24 through the rainwater trap portion 56 passes into the inside of the housing through the filter 38 provided in the top of the housing body 52. The bottom part 50 of the housing 24 supports the air tank 20 through support studs 66 made of a damper rubber.

The above is the outline of the air pump according to the present invention. The following is an explanation of the details of the air pump.

Figure 5:
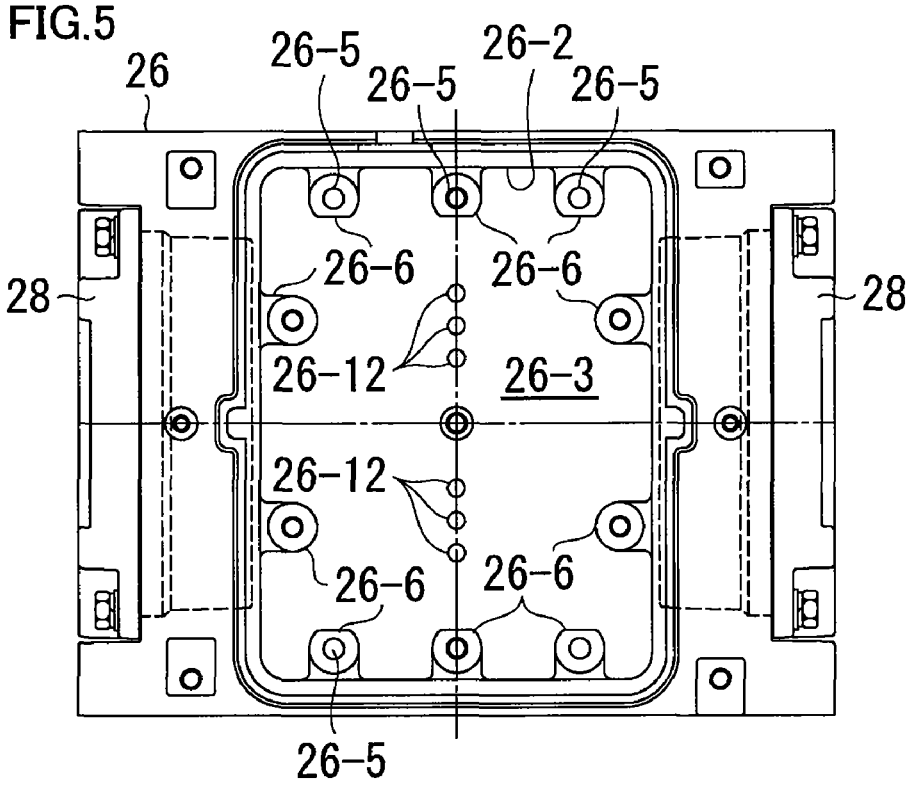
FIG. 5 is a bottom view of the assembly of the casing body and the cylinder bodies.

FIG. 3 shows an assembly of the casing body 26, and a pair of cylinder members 28 fitted into the left and right (as seen in the figure) through-holes 26-1, respectively, of the casing body 26 to constitute the casing 17, and also shows an assembly of the pistons 16 and the armature 34, which is to be loaded into the first-mentioned assembly. The casing body 26 has an electromagnet-loading opening 26-2 in the center of the bottom wall thereof. As shown in FIG. 5, the opening 26-2 is rectangular in shape as seen from below. Regarding the pair of cylinder members 28, one cylinder member 28 is inserted into one through-hole 26-1 and bolted, and the other cylinder member 28 is inserted into the other through-hole 26-1 and bolted in a state where a circular cylindrical inner peripheral surface 28-1 of the other cylinder member 28, which receives the associated piston 16, is axially aligned with the inner peripheral surface 28-1 of the one cylinder member 28 (see FIGS. 4 and 5). The assembly of the armature 34 and the pistons 16 can, as shown in FIG. 3, be inserted into the casing body 26 from one end side thereof through one cylinder member 28.

Figure 6:
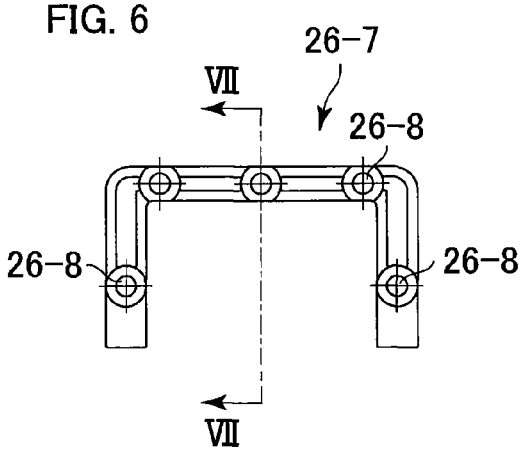
FIG. 6 is a plan view of an electromagnet pedestal member.
Figure 7:
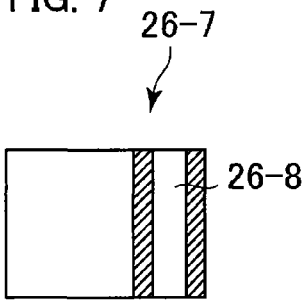
FIG. 7 is a sectional view taken along the line VII-VII in FIG. 6.
Figure 8:
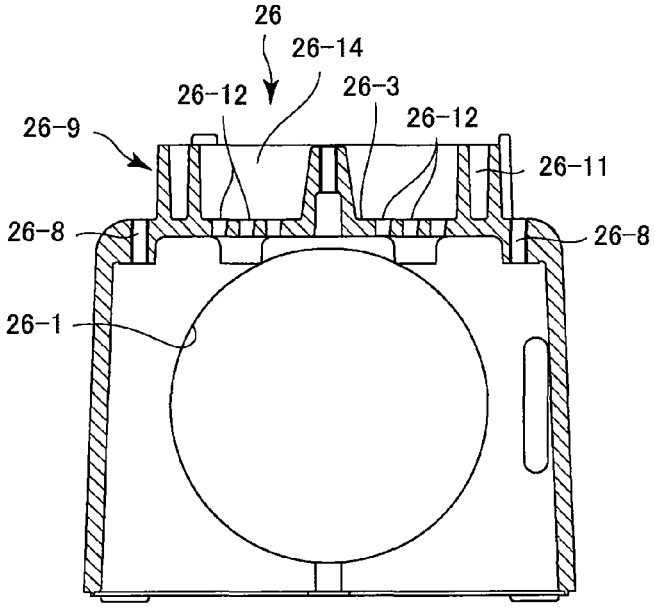
FIG. 8 is a sectional view taken along the line VIII-VIII in FIG. 9.

As shown in FIGS. 5 and 3, the casing body 26 has a top wall 26-3 with an inner surface 26-4 corresponding to the electromagnet-loading opening 26-2 of the bottom wall thereof. The inner surface 26-4 of the top wall 26-3 is provided with mutually spaced internal thread portions 26-6 having threaded holes 26-5 vertically extending through the top wall 26-3. The internal thread portions 26-6 are provided corresponding to the peripheral edge of the bottom opening 26-2. The internal thread portions 26-6 are provided symmetrically about a horizontal line as seen in FIG. 5. As shown in FIGS. 6 and 7, a U-shaped electromagnet pedestal member 26-7 has holes 26-8 provided corresponding to the threaded holes 26-5. The electromagnet pedestal member 26-7 is provided for each of the upper and lower groups of internal thread portions 26-6 and abutted against the associated internal thread portions 26-6. As shown in FIG. 2, bolts 36-1 are inserted through the electromagnets 36 from below and further through the holes 26-8 and thread-engaged with the threaded holes 26-5 of the internal thread portions 26-6, thereby setting the electromagnets 36 at respective proper positions with respect to the permanent magnets 32 of the armature 34.

Figure 9:
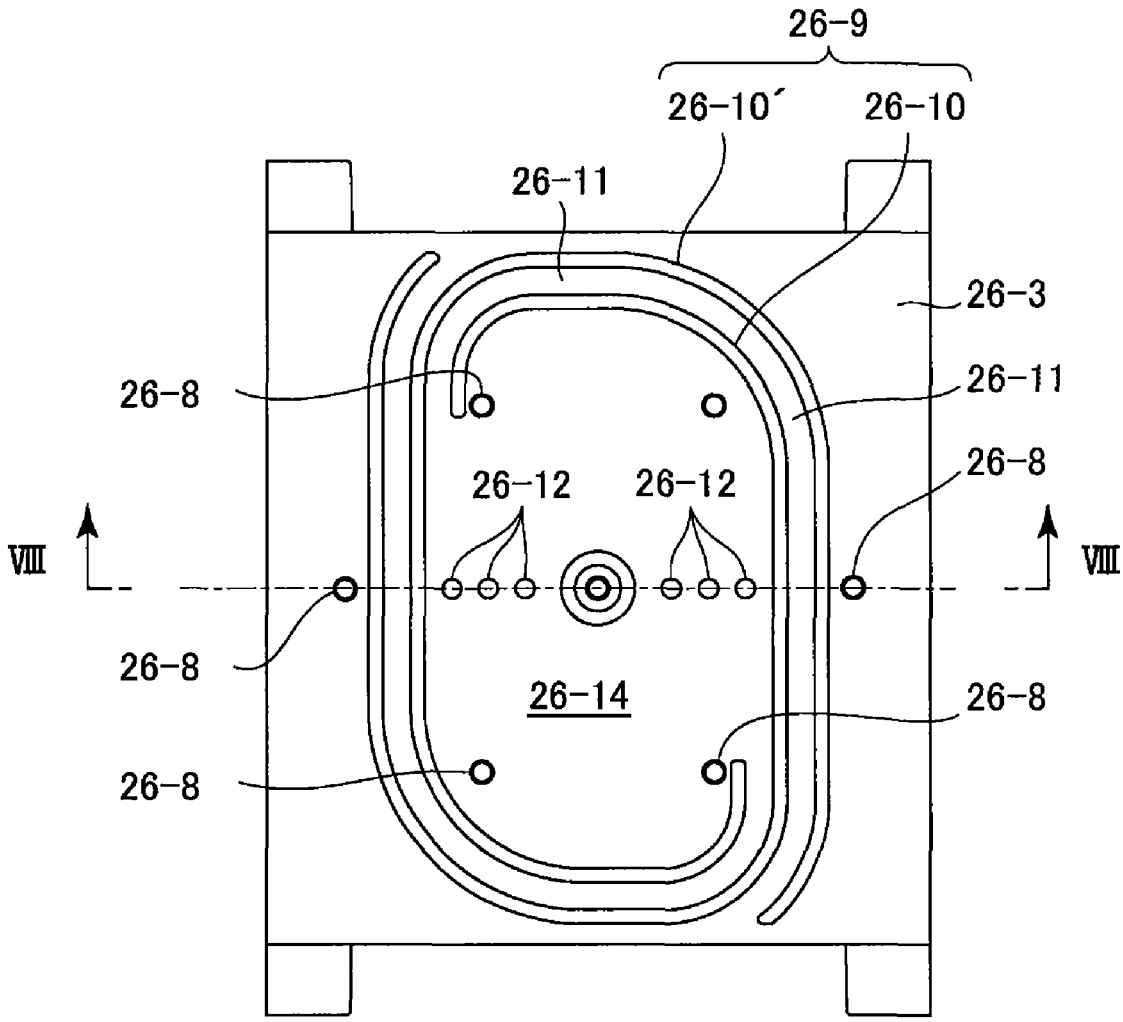
FIG. 9 is a plan view of the casing body.

The casing body 26 has a noise reduction wall 26-9 standing on the upper surface of the top wall 26-3. Specifically, the noise reduction wall 26-9 comprises, as shown in FIG. 9, a pair of parallel extending loop-shaped or annular walls 26-10 and 26-10'. One wall 26-10 extends counterclockwise from the upper right of the figure through about 360° such that the terminating end of the wall 26-10 is inward of the starting end thereof. The other wall 26-10' extends clockwise from a lower right position in parallel to and inward of the one wall 26-10, passes inward of the starting end of the one wall 26-10, and further extends parallel to the one wall 26-10. The other wall 26-10' extends through about 360° in total. Between the walls 26-10 and 26-10' is formed an air intake passage 26-11 also functioning as a noise reduction passage. A plate-shaped lid member 29 is placed on and bolted to the top of the noise reduction wall 26-9. Thus, a noise reduction chamber 26-14 is defined by the outer peripheral surface of the housing, the noise reduction wall 26-9 and the lid member 29. Air introduced into the housing body 52 through the filter 38 provided in the top of the housing body 52 enters the noise reduction chamber 26-14 through the noise reduction passage 26-11 and is introduced into the casing body 26 through holes 26-12 (FIGS. 2 and 5) provided to extend through the top wall 26-3. The inner surface defining the holes 26-12 of the top wall 26-3 extends downward to lengthen the holes 26-12. The noise reduction wall 26-9, the noise reduction chamber 26-14, the holes 26-12 and so forth are configured so that noise generated by the reciprocating motion of the armature 34 is reduced and suppressed from being transmitted to the outside through air-introducing passages such as the holes 26-12, the noise reduction chamber 26-14 and the noise reduction passage 26-11.

Figure 10:
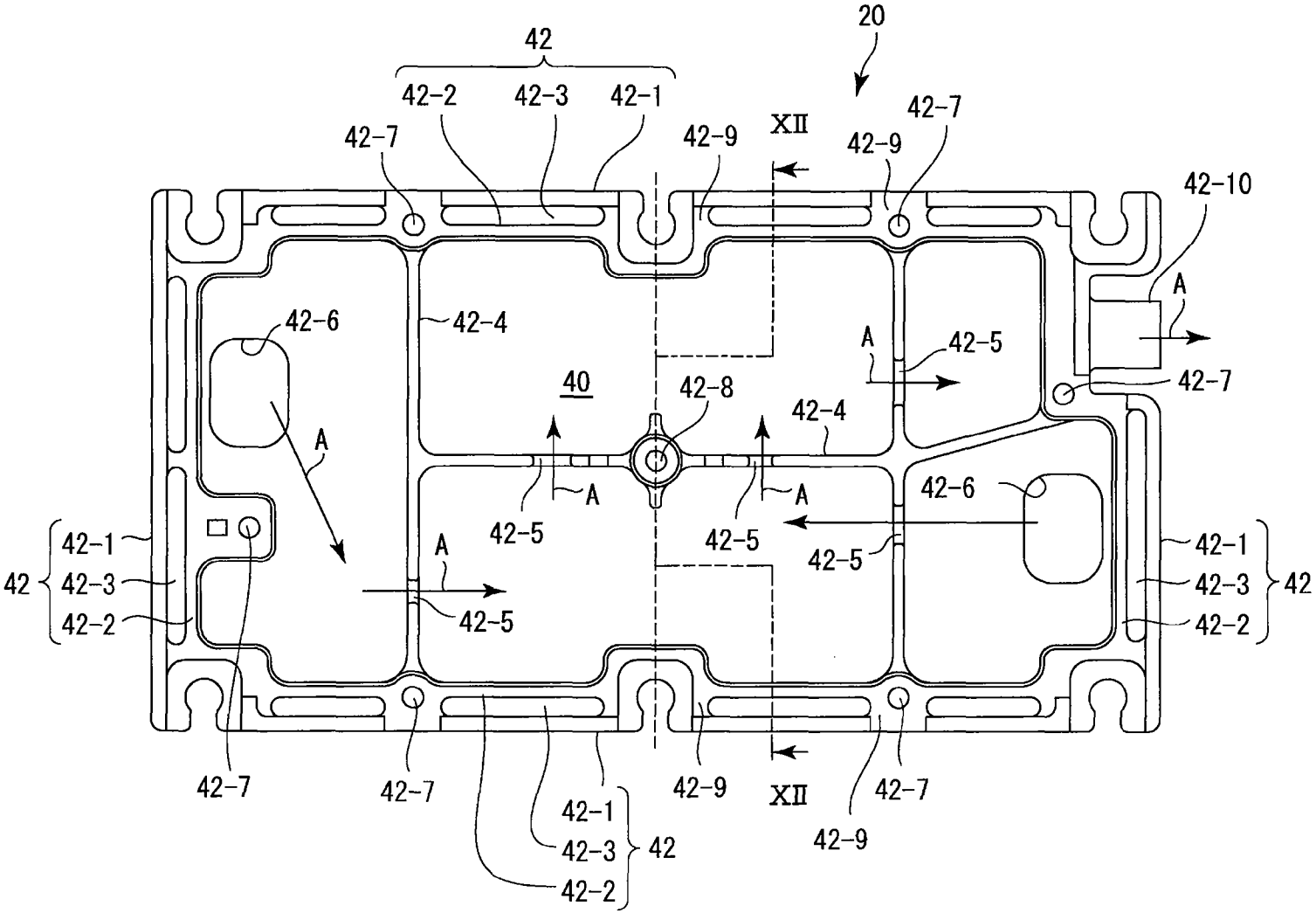
FIG. 10 is a bottom view of a tank body.
Figure 11:
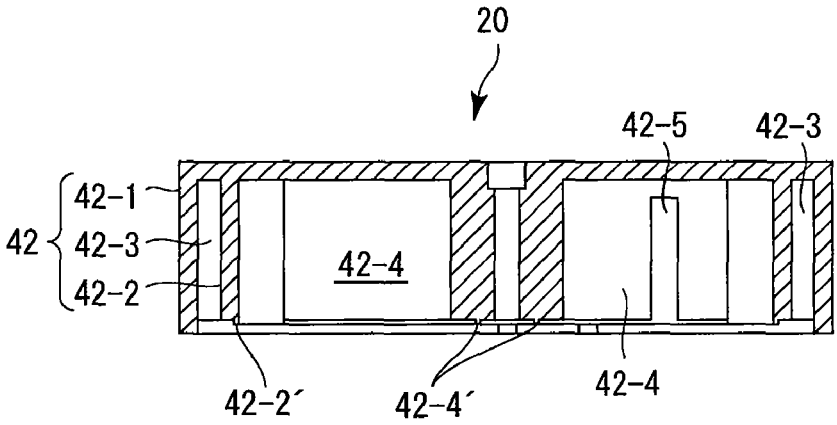
FIG. 11 is a sectional view taken along the line XI-XI in FIG. 10.
Figure 13:
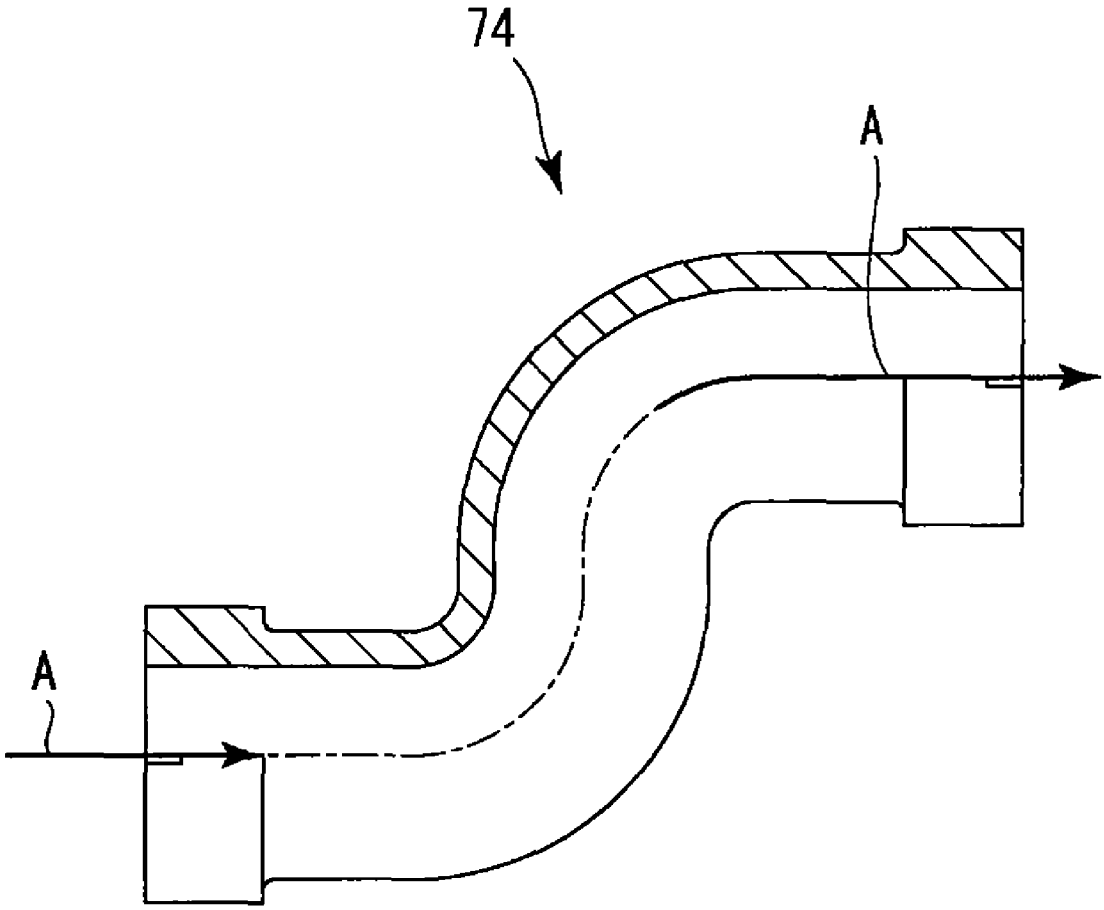
FIG. 13 is a plan view of an S-shaped pipe connecting between an air outlet of an air tank and an air discharge port of a housing.

The air tank body 44 has a peripheral wall 42 having a double-wall structure comprising, as shown in FIGS. 1, 10 and 11, an outer wall 42-1, an inner wall 42-2, and an air gap 42-3 provided between the outer and inner walls 42-1 and 42-2, thereby making it difficult for the vibration noise of air in the tank to be transmitted to the outside. In the illustrated example, a plurality of air gaps 42-3 are formed being spaced from each other in the circumferential direction of the peripheral wall 42. An intermediate wall 42-9 is formed between each pair of mutually adjacent air gaps 42-3 to connect together the outer and inner walls 42-1 and 42-2. In the air tank body 44, partition walls 42-4 are formed being suspended from the top wall 40 of the air tank body 44 to partition the interior space of the air tank body 44 into a plurality of spaces. Each partition wall 42-4 is provided with an air passage 42-5 extending upward from the bottom of the partition wall 42-4. Air introduced from air inlets 42-6 provided in the top wall 40 flows to an air outlet 42-10 through the air passages 42-5, thereby suppressing the pulsation of air discharged from the air outlet 42-10. The partition walls 42-4 and the inner wall 42-2 are shorter in length than the outer wall 42-1. The air outlet 42-9 is connected to an air discharge port 50-1 of the housing bottom part 50 through an S-shaped pipe 74 as shown in FIG. 13. The purpose of using the S-shaped pipe 74 is to absorb vibrations between the housing bottom part 50 and the air tank 20.

The peripheral wall 42 is provided with a plurality of screw-receiving holes 42-7 vertically extending therethrough. The bolts 47 inserted through the peripheral portion of the bottom wall member 46 are passed through the screw-receiving holes 42-7 and thread-engaged with the bottom portion of the casing 17, thereby clamping the air tank body 44 between the bottom wall member 46 and the bottom portion of the casing 17. The partition wall 42-4 in the center of the air tank body 44 is also provided with a screw-receiving hole 42-8. A bolt 49 inserted through the center of the bottom wall member 46 is passed through the screw-receiving hole 42-8, and the distal end of the bolt 49 is thread-engaged with a nut 49-1 fitted into the upper end of the screw-receiving hole 42-8, thereby securing the bottom wall member 46 to the tank body 44. The bottom wall member 46 has a sheet-shaped seal member 43 stacked on the upper surface thereof inside the outer wall 42-1 of the air tank body 44. The seal member 43 is made of a material more pliable than the resin used to form the air tank body 44. Thus, the inner wall 42-2 and partition walls 42-4 of the air tank body 44 sealingly clamp the seal member 43 between themselves and the bottom wall member 46. As shown in FIG. 11, ridges 42-2' and 42-4' capable of being forced into the seal member 43 are provided on the bottoms of the inner wall 42-2 and partition walls 42-4 of the air tank body 44 to extend along the respective walls.

Figure 12:
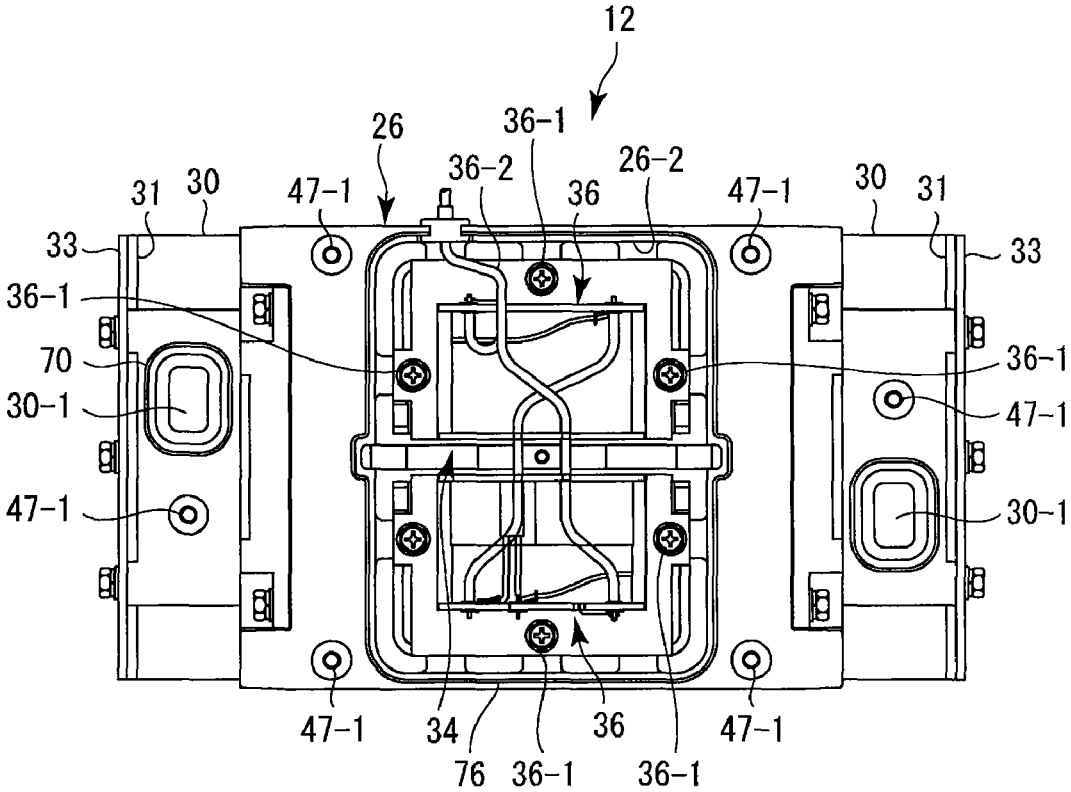
FIG. 12 is a bottom view of the pump unit.

FIG. 12 is a bottom view of the pump unit 12. Through the electromagnet-loading opening 26-2 of the casing body 26 are seen the armature 34 and the electromagnets 36 provided at the opposite sides of the armature 34, together with wiring 36-2 to the electromagnets 36. Threaded holes 47-1 are formed in the respective bottoms of the casing body 26 and the head covers 30. The distal (upper) ends of the bolts 47 are thread-engaged with the threaded holes 47-1, respectively, to secure the air tank body 44 as stated above The bottoms of the head covers 30 are further formed with air discharge openings 30-1, respectively, from which air discharged from the cylinder chambers 14 is discharged toward the air tank 20. The air discharge openings 30-1 are positioned to align with the air inlets 42-6 formed in the top wall 40 of the air tank body 44, which are shown in FIG. 10. Around the air discharge openings 30-1, annular ridges 70 are formed along the peripheral edges of the air discharge openings 30-1, respectively, so as to be forced into a sheet-shaped seal member 76 that is clamped between the air tank 20 and the bottom of the pump unit 12 when the former is secured to the latter, thereby sealingly engaging with the seal member 76. Around the electromagnet-loading opening 26-2, an annular ridge 76 is formed along the peripheral edge of the opening 26-2 so as to engage with the peripheral edge of an opening formed in the seal member 76 corresponding to the electromagnet-loading opening 26-2.

What is claimed is:

1. An air pump comprising:

a pump unit; and an air tank for temporarily storing compressed air compressed in the pump unit before discharging the compressed air from the air pump, the air tank comprising a resinous tank body having a top wall on which the pump unit is placed, and a peripheral wall extending downward from the top wall, the tank body having a downward facing opening, the air tank further comprising a metallic bottom wall member engaged with a bottom surface of the peripheral wall so as to close the opening of the tank body;

wherein bolts are passed through the metallic bottom wall member and into a metallic part of the pump unit and tightened to securely connect the pump unit and the air tank to each other.

2. The air pump of claim 1, wherein the peripheral wall has a double-wall structure comprising an outer wall, an inner wall, and at least one air gap between the outer wall and the inner wall.

3. The air pump of claim 2, wherein the at least one air gap comprises a plurality of air gaps spaced from each other in a circumferential direction of the peripheral wall, and an intermediate wall is provided between adjacent ones of the air gaps to connect together the outer wall and the inner wall.

4. The air pump of claim 1, wherein the tank body has a partition wall extending downward from the top wall thereof to partition an interior of the tank body into a plurality of spaces, the partition wall having an air passage formed therein to allow air introduced into the air tank to flow toward an air outlet of the air pump through the plurality of spaces, the partition wall being shorter in height than the peripheral wall, and wherein a seal member is provided between the partition wall and the bottom wall member, the seal member being more pliable than a resin used to form the tank body.

5. The air pump of claim 3, wherein the tank body has a partition wall extending downward from the top wall thereof to partition an interior of the tank body into a plurality of spaces, the partition wall having an air passage formed therein to allow air introduced into the air tank to flow toward an air outlet of the air pump through the plurality of spaces, the inner wall and the partition wall being shorter in height than the outer wall, and wherein a seal member is disposed with the inner wall and the partition wall positioned on an one side of the seal member and with the bottom wall member positioned on an other side of the seal member, the seal member being more pliable than a resin used to form the tank body.

6. The air pump of claim 5, wherein the seal member is a sheet-shaped member stacked on an inner surface of the bottom wall member so that the inner wall and the partition wall sealingly engage with the seal member.

7. The air pump of claim 1, wherein the pump unit includes:

a piston assembly of a pair of pistons and an armature connecting together the pair of pistons in a state that the pair of pistons being aligned with each other in an axial direction of the pistons;

a pair of electromagnets provided at opposite sides, respectively, of the armature, wherein, when an alternating electric current is applied to the electromagnets, the electromagnets generate an alternating magnetic field to reciprocate the armature in the axial direction of the pistons; and a pump casing comprising a pair of cylinder chambers slidably accommodating the pair of pistons, respectively, and a drive chamber accommodating the armature extending between the pair of cylinder chambers and the electromagnets, the pump casing comprising a peripheral wall defining the drive chamber, the peripheral wall of the pump casing having an electromagnet-loading opening extending through a bottom wall portion of the peripheral wall to allow the electromagnets to be loaded into the drive chamber from an outside of the peripheral wall;

wherein the top wall of the air tank is sealingly engaged with the bottom wall portion of the pump casing to close the electromagnet-loading opening.

8. The air pump of claim 4, wherein the pump unit includes:

a piston assembly of a pair of pistons and an armature connecting together the pair of pistons in a state that the pair of pistons are aligned with each other in an axial direction of the pistons;

a pair of electromagnets provided at opposite sides, respectively, of the armature, wherein, when an alternating electric current is applied to the electromagnets, the electromagnets generate an alternating magnetic field to reciprocate the armature in the axial direction of the pistons; and a pump casing comprising a pair of cylinder chambers slidably accommodating the pair of pistons, respectively, and a drive chamber accommodating the armature extending between the pair of cylinder chambers and the electromagnets, the pump comprising a peripheral wall defining the drive chamber, the peripheral wall of the pump casing having an electromagnet-loading opening extending through a bottom wall portion of the peripheral wall to allow the electromagnets to be loaded into the drive chamber from an outside of the peripheral wall;

wherein the top wall of the air tank is sealingly engaged with the bottom wall portion of the pump casing to close the electromagnet-loading opening.

9. The air pump of claim 7, wherein the bottom wall portion of the pump casing has an air discharge opening for discharging air compressed in the pump unit to an outside of the pump casing, the air tank having an air inlet disposed to face the air discharge opening, and wherein an annular seal member is provided between the top wall of the air tank and the bottom wall portion of the pump casing so as to surround an air passage between the air discharge opening and the air inlet.

10. The air pump of claim 8, wherein the bottom wall portion of the pump casing has an air discharge opening for discharging air compressed in the pump unit to an outside of the pump casing, the air tank having an air inlet disposed to face the air discharge opening, and wherein an annular seal member is provided between the top wall of the air tank and the bottom wall portion of the pump casing so as to surround an air passage between the air discharge opening and the air inlet.

* * * * *